United States Patent [19]

Häusler et al.

[11] 4,237,778

[45] Dec. 9, 1980

[54] MACHINE FOR MAKING RECESSED COMPOSITE FILTER MOUTHPIECES

[75] Inventors: Nikolaus Häusler, Oststeinbek; Erich Berger, Hamburg; Wolfgang Wiese, Hamwarde, all of Fed. Rep. of Germany

[73] Assignee: Hauni-Werke Körber & Co. KG, Hamburg, Fed. Rep. of Germany

[21] Appl. No.: 16,528

[22] Filed: Mar. 1, 1979

[30] Foreign Application Priority Data

Mar. 15, 1978 [DE] Fed. Rep. of Germany ..... 2811176

[51] Int. Cl.[3] ..... A24C 5/50

[52] U.S. Cl. ..... 493/39; 198/425

[58] Field of Search ..... 93/77 FT, 1 C; 198/425, 198/459, 461

[56] References Cited

U.S. PATENT DOCUMENTS

| | | | |
|---|---|---|---|
| 2,953,878 | 9/1960 | Schur | 93/1 C UX |
| 3,131,612 | 5/1964 | Rowlands | 93/1 C |
| 3,143,202 | 8/1964 | Rowlands | 198/459 |
| 3,424,293 | 1/1969 | Deutschländer | 198/425 |
| 3,662,875 | 5/1972 | Salomon | 198/425 |
| 4,044,659 | 8/1977 | Bardenhagen et al. | 93/77 FT |
| 4,093,063 | 6/1978 | Calvert et al. | 198/425 |

FOREIGN PATENT DOCUMENTS 21211 5/1961 German Democratic Rep. .

*Primary Examiner*—James F. Coan

*Attorney, Agent, or Firm*—Peter K. Kontler

[57] ABSTRACT

A continuous filter rod which can be severed to yield recessed composite filter mouthpieces is obtained by feeding groups of assorted dissimilar coaxial filter plugs onto the adhesive-coated side of a running web of wrapping material and inserting a phantom plug of selected length between each previously transferred group and the next-following group to insure that the width of gaps between neighboring groups matches the length of the phantom plug. The phantom plug is withdrawn as soon as the next-following group adheres to the web, and the web is draped around the resulting filler to form therewith a continuous filter rod wherein groups of dissimilar filter plugs alternate with gaps. When the filter rod is severed centrally across a gap, the adjacent portions of the filter rod constitute two recessed filter mouthpieces. Each gap is flanked by plugs consisting of identical filter material.

10 Claims, 5 Drawing Figures

MACHINE FOR MAKING RECESSED COMPOSITE FILTER MOUTHPIECES

BACKGROUND OF THE INVENTION

The present invention relates to a machine for making composite filter mouthpieces for cigarettes or analogous rod-shaped smokers' products. More particularly, the invention relates to a machine for the production of so-called recessed composite filter mouthpieces wherein the outermost part of the filter of the mouthpiece is remote from the free end thereof. Still more particularly, the invention relates to improvements in a machine for making a continuous filter rod which can be subdivided into recessed composite filter mouthpieces.

In many heretofore known machines for the making of recessed filter mouthpieces, the filler of the filter rod is assembled of discrete filter plugs or discrete groups of dissimilar filter plugs which are disposed one behind the other and are separated from each other by gaps which, in the finished mouthpieces, constitute recesses at the free ends of such mouthpieces. A drawback of such machines is that the width of gaps between neighboring filter plugs or groups of filter plugs is not uniform so that the depth of recesses at the free ends of mouthpieces varies from item to item. This is undesirable for a number of reasons, primarily because it is annoying to a smoker who is accustomed to smoking cigarettes with recessed filter mouthpieces and detects that his or her tongue contacts the wad or plug of filter material in the mouthpiece of the lighted cigarette.

Commonly owned East German patent No. 21,211 discloses a machine for the making of recessed filter mouthpieces wherein each mouthpiece contains only one type of filter material. Filter plugs are transported by a drum having peripheral phantom plugs and serving to deliver discrete spaced-apart filter plugs onto a running web of wrapping material whereon the plugs are held by spikes of the garniture or by spikes of a rotating drum. Such machines are not suited for the mass production of composite (multiplex) recessed filter mouthpieces.

U.S. Pat. No. 2,953,878 to Schur discloses a filter rod making apparatus wherein assorted filter plugs are introduced into a tube and the thus obtained groups are pushed axially forwardly to form a continuous filler which is draped into a web of cigarette paper and is thereupon severed to yield composite filter mouthpieces without recesses. The patented apparatus cannot be used for the mass production of composite filter mouthpieces or for the mass production of composite recessed filter mouthpieces because, once the speed of moving parts exceeds a certain value, the filter plug at the end of each group is subjected to excessive mechanical stresses during forward movement toward the trailing end of the filler.

U.S. Pat. Nos. 3,131,612 and 3,143,202 to Rowlands disclose machines for the making of recessed filter mouthpieces with a feed screw which is parallel to the path of the filler and separates groups of assorted filter plugs from each other. The operation is slow and the filter plugs are subjected to pronounced mechanical stresses.

OBJECTS AND SUMMARY OF THE INVENTION

An object of the invention is to provide a simple machine for mass-production of recessed composite filter mouthpieces with a heretofore unmatched degree of accuracy.

Another object of the invention is to provide a machine which insures that the depth of each recess in a finished composite filter mouthpiece matches the desired depth.

A further object of the invention is to provide a novel and improved machine for making a rod-like filler which can be converted into recessed composite filter mouthpieces.

An additional object of the invention is to provide a novel and improved machine for making a continuous filter rod which can be converted into recessed composite filter mouthpieces.

An additional object of the invention is to provide a machine which can produce a continuous filter rod at a high speed and in such a way that the rod can be subdivided into identical recessed composite filter mouthpieces.

Another object of the invention is to provide the machine with novel and improved means for maintaining selected solid components of the filler of the filter rod at a desired distance from each other.

A further object of the invention is to provide a machine whose output exceeds the output of conventional machines for the making of recessed composite filter mouthpieces and which is not more complex but rather simpler than such conventional machines.

An ancillary object of the invention is to provide a novel and improved transfer conveyor for use in the above outlined machine.

One feature of the invention resides in the provision of a machine for producing a filter rod for subdivision into recessed composite mouthpieces. The machine comprises means for assembling dissimilar filter plugs into a series of groups of assorted coaxial filter plugs including means for moving the plugs and the groups sideways, means for moving a continuous adhesive-coated web of cigarette paper or other suitable wrapping material lengthwise along a predetermined path, means for transferring successive groups of the series onto the moving web, one behind the other so that the transferred groups form a rod-like filler consisting of coaxial groups, including means for inserting a phantom plug of predetermined length between each previously transferred group and the next-following group and for withdrawing the phantom plug as soon as the next-following group adheres to the moving web whereby the withdrawal of the phantom plug results in the formation of a gap of predetermined length between neighboring groups of the filler, and means for draping the web around the filler to form a continuous filter rod wherein groups of filter plugs alternate with gaps. When the filter rod is severed across a gap, the rod portions which are adjacent to the plane of cut form two recessed composite filter mouthpieces.

The assembling means may include means for placing filter plugs of a first type between pairs of spaced-apart filter plugs of a second type so that each group comprises a centrally located filter plug of the first type and two filter plugs of the second type. The filter plugs of the second type flank the respective filter plug of the first type.

The assembling means may include means for placing filter plugs of one type at the ends of each group and at least one filter plug of another type between the filter plugs of the one type so that each gap in the filler is disposed between two filter plugs of the one type (i.e., between two filter plugs having identical characteristics).

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2, 3, 4, 5:
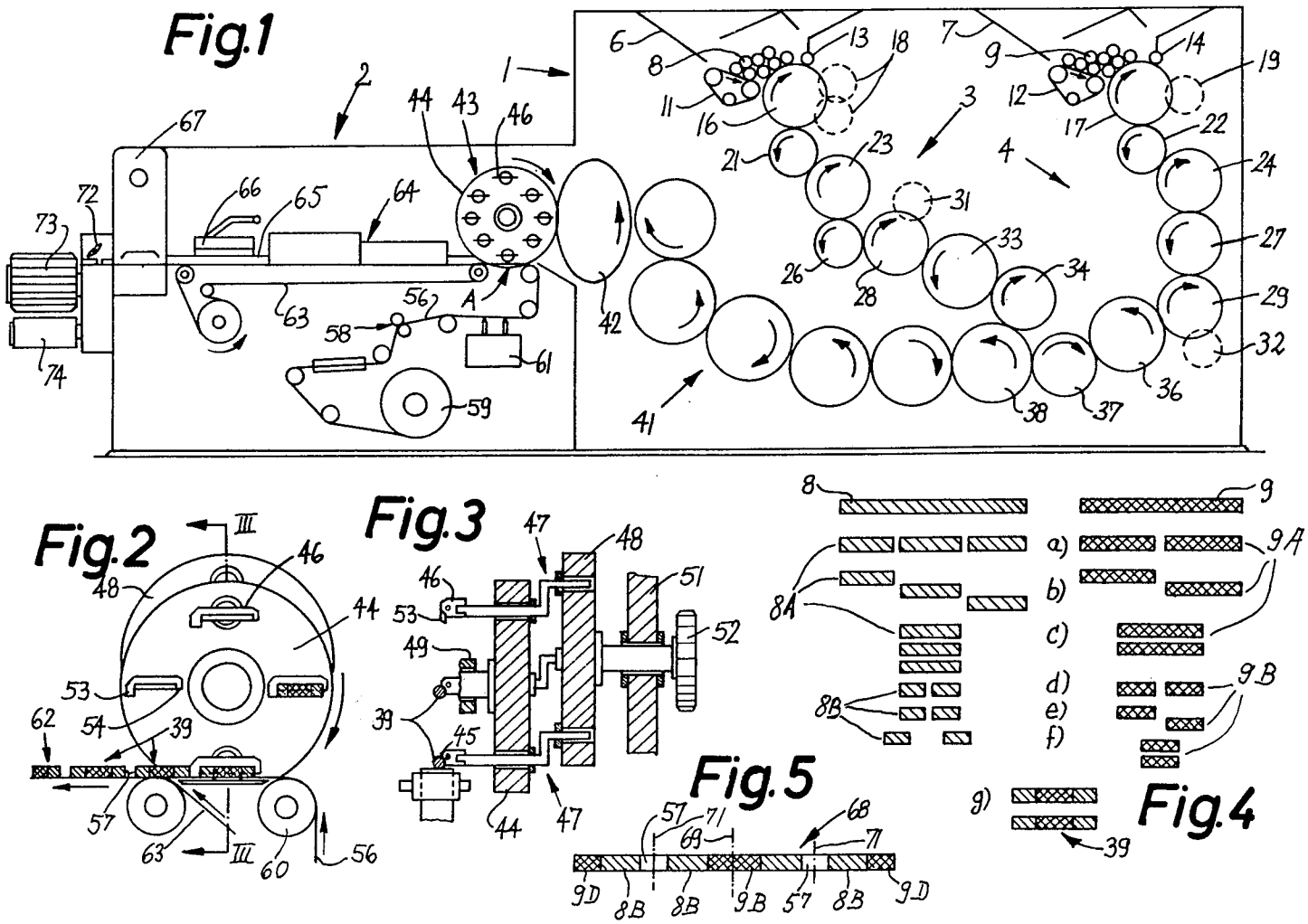
FIG. 1 is a schematic elevational view of a machine which embodies the invention.
FIG. 2 is an enlarged front elevational view of the transfer conveyor for groups of assorted dissimilar filter plugs.
FIG. 3 is a transverse vertical sectional view as seen in the direction of arrows from the line III—III of FIG. 2.
FIG. 4 illustrates the manner in which the group assembling unit of the machine of FIG. 1 manipulates dissimilar filter rod sections and filter plugs.
FIG. 5 is an enlarged central longitudinal sectional view of a filter mouthpiece of four times unit length.

FIG. 1 shows a machine for the production of recessed filter mouthpieces, namely, mouthpieces wherein the rearmost filter element or plug is remote from the free end of the mouthpiece. The machine comprises two main units, namely, a filter plug assembling unit 1 and a filter rod forming unit 2. The filter rod which is formed in the unit 2 is severed at regular intervals to yield mouthpieces of desired length.

The assembling unit 1 comprises a first set 3 of conveyors which manipulate filter rod sections 8 of a first type, and a second set 4 of conveyors which manipulate filter rod sections 9 of a second type. The sections 8 and 9 are respectively stored in magazines 6 and 7. The magazine 6 comprises a mobile wall portion 11 which constitutes an endless belt conveyor and serves to aim filter rod sections 8 into the peripheral flutes (not specifically shown) of a rotary drum-shaped severing conveyor 16 which cooperates with two rotary disk-shaped knives 18 to subdivide each section 8 into three shorter sections 8A shown in FIG. 4*a*. A portion of the severing conveyor 16 extends into the outlet of the magazine 6. The reference character 13 denotes a rotary refuser roller which prevents escape of filter rod sections 8 from the magazine 6 at the downstream side of the outlet and further insures that the sections 8 are not damaged in the region where successive increments of the peripheral surface of the conveyor 16 advance beyond the outlet. The conveyor 16 delivers the shorter sections 8A to three disks of a staggering conveyor 21 whose disks rotate at different speeds and/or transport the respective sections 8A through different distances so that the sections 8A are staggered with respect to each other, as considered in the circumferential direction of the conveyor 21 (and as shown in FIG. 4*b*) prior to transfer into successive flutes of a shuffling conveyor 23 which cooperates with suitable cams or guide rails (not shown) to form a single row of sections 8A (see FIG. 4*c*) wherein each preceding section is in exact register with the next-following section. The shuffling conveyor 23 delivers successive sections 8A of the thus obtained row into the peripheral flutes of an accelerating conveyor 26 which delivers the sections 8A into successive peripheral flutes of a rotary drum-shaped severing conveyor 28 which cooperates with a rotary knife 31 to subdivide each section 8A into two shorter sections or plugs 8B (FIG. 4*d*). The pairs of coaxial sections 8B are delivered to a transfer conveyor 33 (FIG. 4*e*) which delivers such pairs to a spreading conveyor 34 cooperating with a plough or the like (not shown) to move the sections 8B of each pair axially and away from each other (FIG. 4*f*) and to this provide room for introduction of a filter rod section or plug 9B. Such introduction takes place in the flutes of an assembly conveyor 38.

The magazine 7 has a mobile wall portion 12 and a refuser roller 14 (respectively corresponding to the parts 11 and 13) and an outlet which receives a portion of a severing conveyor 17 corresponding to the conveyor 16. The conveyor 17 cooperates with a knife 19 to subdivide each section 9 into two shorter sections 9A (FIG. 4*a*). The sections 9A of each pair are transferred onto the disks of a staggering conveyor 22 corresponding to the conveyor 21 and serving to move the sections 9A of successive pairs out of axial alignment with each other (see FIG. 4*b*) prior to transfer into successive flutes of a shuffling conveyor 24 corresponding to the conveyor 23. The conveyor 24 cooperates with guide rails (not shown) to form a single row of accurately aligned sections 9A (see FIG. 4*c*) prior to transfer into successive flutes of an accelerating conveyor 27 which delivers successive sections 9A into the flutes of a rotary drum-shaped severing conveyor 29 cooperating with a knife 32 to subdivide each section 9A into two coaxial sections or plugs 9B (see FIG. 4*d*). The pairs of sections or plugs 9B are introduced into the disks of a staggering conveyor 36 which staggers the plugs 9B in a manner as shown in FIG. 4*e* and delivers successive plugs 9B into successive flutes of a shuffling conveyor 37 which forms a single row of accurately aligned sections 9B (see FIG. 4*f*) for delivery of successive plugs 9B into the flutes of the assembly conveyor 38. The plugs 9B are delivered in such positions that each thereof is flanked by two coaxial plugs 8B when the respective flute of the assembly conveyor 38 advances beyond the transfer station between the conveyors 34, 38. The thus obtained groups 39 of assorted plugs (each of which consists of a centrally located plug 9B and two plugs 8B which flank the respective plug 9B (see FIG. 4*g*) are condensed by moving between two guide rails so that the inner end faces of the plugs 8B abut against the respective end faces of the corresponding plug 9B. On their way from the magazines 6 and 7 to the assembly conveyor 38, the sections 8, 8A, 9, 9A and plugs 8B, 9B move sideways.

The condensed groups 39 are transported sideways by a battery of intermediate conveyors 41 to the level of the rod forming station in the unit 2. The last intermediate conveyor 41 delivers successive groups 39 to a conical inserting conveyor 42 which, in turn, delivers such groups into successive holders 46 of a transfer conveyor 43 which delivers successive groups 39 into the unit 2 in such a way that the groups are disposed one behind the other, i.e., they form a single file of coaxial groups with gaps 57 (FIG. 2) between neighboring groups. The transfer conveyor 43 is a so-called Schmidt coupling whose holders 46 support the respective plugs 39 from above and in such a way that the orientation of the groups remain unchanged. In the embodiment of FIG. 1, the groups 39 remain horizontal during transport in the holders 46 from the transfer station between the conveyors 42, 43 to the transfer station A at the six o'clock position of the conveyor 43. A suitable Schmidt coupling is disclosed in the "Product Licensing Index" dated Oct. 1, 1976.

As shown in FIG. 3, the holders 46 are adjacent to the outer side of a first disk-shaped carrier 44 and are pivotable with respect thereto. The means for preserving the orientation of holders 46 during movement toward and beyond the transfer station A comprises crank arms 47 which couple the carrier 44 to a second carrier 48 of the transfer conveyor 43. The carrier 44 is eccentric with respect to the carrier 48, and the two carriers are driven to rotate in synchronism with each other. The carrier 44 is rotatably mounted in a wall 49 of the frame of the machine and rotates in suitable bearings, not specifically shown. The carrier 48 is rotatable in a second wall 51 of the frame and receives torque from a gear 52.

The holders 46 have suction ports (not specifically shown) which attract the respective groups 39 during transport from the transfer station between the conveyors 42, 43 to the transfer station A. The manner of providing such suction ports in transfer conveyors for use in filter rod making machines is well known from the art. Reference may be had to commonly owned U.S. Pat. No. 3,952,865 granted Apr. 27, 1976 to Willy Rudszinat et al.

The leading end of each holder 46 (namely, the left-hand end, as viewed in FIG. 1 or 2), has a distancing element 53 which constitutes a phantom plug and causes the formation of a gap 57 between successive groups 39 in the unit 2. The other (trailing) end of each holder 46 is provided with an entraining projection 54. The conical inserting conveyor 42 changes the orientation of successive groups 39 by 90 degrees (i.e., a plug 39 which is delivered to the transfer station between the last intermediate conveyor 41 and the inserting conveyor 42 is disposed at right angles to the plane of FIG. 1, and the axis of each plug 39 which is delivered to an oncoming holder 46 is parallel to the plane of FIG. 1) and inserts the plugs 39 in such a way that each plug is located between the distancing element 53 and the entraining projection 54 of the respective holder 46. The holders 46 have elongated flutes 45 which extend between the respective distancing elements 53 and projections 54 and serve to receive portions of the respective groups 39. The flutes 45 communicate with the aforementioned suction ports to insure that the groups 39 remain (i.e., are suspended) in the respective holders 46 during transport toward the station A. The path along which the holders 46 transport the groups 39 is an arcuate path having a constant curvature.

The unit 2 comprises a bobbin 59 or an analogous source of web material 56. Such material is withdrawn by two advancing rolls 58 and travels toward an endless belt conveyor 63 known as garniture. One side of the web 56 is coated with adhesive by a paster 61. The web 56 is trained over a guide roll 60 upstream of the transfer station A so that its adhesive-coated side faces upwardly during travel below the transfer conveyor 43. The paster 61 preferably applies two parallel strips of adhesive which latter is preferably a hotmelt. One strip is adjacent to a marginal portion and the other strip is located substantially centrally between the marginal portions of the web 56. The speed at which the holders 46 advance toward the transfer station A equals or closely approximates the speed of the web 56 and garniture 63.

The groups 39 and the gaps 57 (such gaps can be said to constitute cylindrical plugs of air) form a continuous rod-like filler 62 which adheres to the centrally located adhesive strip of the web 56 and advances therewith and with the upper reach of the garniture 63 through a rod forming mechanism 64 which drapes the web 56 around the filler 62 to form therewith a continuous filter rod 65. During draping, the marginal strip of adhesive causes the two overlapping marginal portions of the web to form a seam which extends in the longitudinal direction of the filter rod 65. The phantom plugs 53 insure that the width of each gap 57 (as considered in the axial direction of the filler 62 and rod 65) is the same, and the centrally located strip of adhesive insures that the groups 39 cannot move relative to the web 56 during travel beyond the transfer station A. The seam is thereupon cooled by a suitable sealer 66 to insure that it will not burst open during travel through a cutoff 67 which severs the rod 65 at regular intervals to form a single file of filter mouthpieces 68 (see FIG. 5) of double unit length. The knife or knives of the cutoff 67 sever the rod 65 midway across each plug 9B (the plane of the cut is shown at 69) so that each mouthpiece comprises two filter plugs 9D (each having a length equaling half the length of a plug 9B) two filter plugs 8B and a gap 57 between the plugs 8B. Successive mouthpieces 68 are accelerated by a rapidly rotating cam 72 to enter successive flutes of a rotary drum-shaped row forming conveyor 73 which delivers such mouthpieces onto the upper reach of a belt conveyor 74 serving to transport filter mouthpieces 68 into a filter cigarette making machine. Each mouthpiece 68 is inserted between two plain cigarettes of unit length (not shown) and is connected thereto by an adhesive-coated uniting band to form therewith a filter cigarette of double unit length, and such cigarettes are severed (see the planes 71 in FIG. 5) midway across those portions of the tubular wrappers of the mouthpieces 68 which surround the gaps 57 whereby each gap yields two recesses, one at the free end of the mouthpiece of each filter cigarette of unit length. The manner in which the filter mouthpieces are processed in a filter cigarette making machine is disclosed, for example, in commonly owned U.S. Pat. No. 3,245,414 granted Apr. 12, 1966 to Willy Rudszinat.

If desired,, the cutoff 67 can sever each second plug 9B to form filter mouthpieces of four times unit length (i.e., having the combined length of two mouthpieces 68). Such mouthpieces are severed in the filter cigarette making machine at 69 to yield pairs of mouthpieces 68, and each mouthpiece 68 is assembled with two plain cigarettes to form a filter cigarette of double unit length prior to severing of the mouthpiece 68 in the plane 71.

The assembling unit 1 can be modified to assemble groups each of which contains more than two types of filter elements. This would merely involve the addition of one or more magazines and conveyor sets.

An important advantage of the improved machine is that the transfer conveyor 43 insures the formation of gaps 57 of predictable width as well as that the machine can be readily converted for the making of filter mouthpieces having longer or shorter (i.e., deeper or shallower) recesses by the simple expedient of changing the length of the phantom plugs 53 and/or projections 54. The front face of the phantom plug 53 at the station A touches the rear end face of the preceding group 39 and its rear end face is already in contact with the front end face of the next-following group 39 so that the width of gaps 57 is always the same. The phantom plugs 53 are withdrawn from the filler 62 as soon as the freshly delivered groups 39 adhere to the running web 56.

The illustrated transfer conveyor 43 exhibits the advantage that the groups 39 are deposited gently, at predetermined intervals, on the adhesive-coated upper side of the web 58. This insures that the groups 39 are not likely to be shifted during deposition onto the web. Furthermore, the mode of operation of the transfer conveyor is such that the phantom plugs 53 can be withdrawn from the transfer station A without any displacement of neighboring filter plugs 8B. This is due to the fact that the holders 44 are parallel to the path for the web 56, and also to the construction of the transfer conveyor (as shown in FIGS. 2 and 3).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a machine for producing a filter rod which is subdivisible into recessed composite filter mouthpieces, the combination of means for assembling dissimilar filter plugs into a series of groups of assorted coaxial filter plugs, including means for moving the plugs and the groups sideways; means for conveying an adhesive-coated web of wrapping material lengthwise; means for transferring successive groups of said series onto the moving web, one behind the other so that the transferred groups form a rod-like filler consisting of coaxial groups, said transferring means including at least one phantom plug and holder means for placing said phantom plug between a previously transferred group and the next-following group and for withdrawing the phantom plug as soon as the next-following group adheres to the moving web whereby the withdrawal of said phantom plug results in the formation of a gap between neighboring groups of the filler, said holder means comprising a plurality of discrete holders each having a flute for a group of assorted filter plugs and a phantom plug adjacent to one end of the group in the respective flute; and means for draping the moving web about said filler to form a continuous filter rod wherein said groups alternate with gaps.

2. The combination of claim 1, wherein said assembling means comprises a plurality of magazines for different types of filter rod sections, a set of conveyors and knife means for each magazine and each arranged to transport and subdivide the respective sections into plugs and manipulate the respective plugs, and means for assembling the plugs which are delivered by said sets of conveyors into said series of groups.

3. The combination of claim 1, wherein said flutes are parallel to the web.

4. The combination of claim 1, wherein said transferring means comprises a Schmidt coupling.

5. The combination of claim 1, further comprising means for subdividing said filter rod into discrete mouthpieces each of which contains at least one gap.

6. In a machine for producing a filter rod which is subdivided into recessed composite filter mouthpieces, the combination of means for assembling dissimilar filter plugs into a series of groups of assorted coaxial filter plugs, including means for moving the plugs and the groups sideways; means for conveying an adhesive-coated web of wrapping material lengthwise; means for transferring successive groups of said series onto the moving web, one behind the other so that the transferred groups form a rod-like filler consisting of coaxial groups, said transferring means including at least one phantom plug and holder means for placing said phantom plug between a previously transferred group and the next-following group and for withdrawing the phantom plug as soon as the next-following group adheres to the moving web whereby the withdrawal of said phantom plug results in the formation of a gap between neighboring groups of the filler, said holder means comprising a flute for reception and retention of a group during transfer from said assembling means to the moving web, said phantom plug being located at the forward end of said flute, as considered in the direction of movement of said web; and means for draping the moving web about said filler to form a continuous filter rod wherein said groups alternate with gaps.

7. The combination of claim 6, wherein said flute is parallel to the web.

8. The combination of claim 6, wherein said transferring means comprises a Schmidt coupling.

9. The combination of claim 6, wherein said assembling means comprises a plurality of magazines for different types of filter rod sections, a set of conveyors and knife means for each magazine and each arranged to transport and subdivide the respective sections into plugs and manipulate the respective plugs, and means for assembling the plugs which are delivered by said sets of conveyors into said series of groups.

10. The combination of claim 6, further comprising means for subdividing said filter rod into discrete mouthpieces each of which contains at least one gap.

* * * * *